US008613454B2

(12) United States Patent
Foley

(10) Patent No.: US 8,613,454 B2
(45) Date of Patent: Dec. 24, 2013

(54) UNDER HOOD SERVICE TRAY

(75) Inventor: Patrick Foley, Southhaven, MS (US)

(73) Assignee: KKU, Inc., Tokyo (JP)

( * ) Notice: Subject to any disclaimer, the term of this patent is extended or adjusted under 35 U.S.C. 154(b) by 287 days.

(21) Appl. No.: 12/584,391

(22) Filed: Sep. 4, 2009

(65) Prior Publication Data

US 2011/0056898 A1 Mar. 10, 2011

(51) Int. Cl.
*B25H 5/00* (2006.01)
*A47B 9/00* (2006.01)

(52) U.S. Cl.
USPC ..... 280/32.6; 108/147

(58) Field of Classification Search
USPC ..... 211/133.3, 85.8, 133.1; 108/25, 27, 44, 108/147, 146, 147.19, 147.21; 248/125.9, 248/125.8, 129; 280/32.6, 47.34, 47.35, 280/79.11, 79.3, 638, 35; 254/2 B, 7 R, 98
See application file for complete search history.

(56) References Cited

U.S. PATENT DOCUMENTS

| | | | | |
|---|---|---|---|---|
| 1,660,521 | A * | 2/1928 | Nordgren | 211/70.6 |
| 1,833,829 | A | 11/1931 | Doolin | |
| 1,867,763 | A * | 7/1932 | Lamar | 108/8 |
| 2,701,168 | A * | 2/1955 | Schemers | 182/116 |
| 2,805,778 | A | 9/1957 | Yordi | |
| 2,872,252 | A * | 2/1959 | Konkle | 182/131 |
| 2,925,917 | A | 2/1960 | Kammeyer | |
| 2,962,333 | A | 11/1960 | Policastro | |
| 4,401,036 | A * | 8/1983 | Russo et al. | 108/146 |
| 4,435,863 | A * | 3/1984 | Lerich | 5/87.1 |
| 4,715,573 | A | 12/1987 | Liegel | |
| 5,080,381 | A * | 1/1992 | Perez | 280/35 |
| 5,108,118 | A * | 4/1992 | Schaevitz | 280/32.6 |
| 5,149,114 | A * | 9/1992 | Lewandowski et al. | 280/33.992 |
| 5,165,632 | A * | 11/1992 | Kuan | 248/129 |
| 5,181,681 | A * | 1/1993 | Edwards | 248/125.1 |
| 5,330,209 | A * | 7/1994 | Pool | 280/32.6 |
| 5,374,019 | A * | 12/1994 | Fischer | 248/125.7 |
| 5,460,392 | A * | 10/1995 | Hansen | 280/32.6 |
| 5,511,674 | A * | 4/1996 | Boyd et al. | 211/70.6 |
| D381,835 | S * | 8/1997 | Corpuz et al. | D6/426 |
| D394,965 | S * | 6/1998 | Fang | D6/474 |
| 5,971,512 | A * | 10/1999 | Swan | 312/281 |
| 6,240,856 | B1 * | 6/2001 | Paskey et al. | 108/146 |
| 6,688,634 | B2 * | 2/2004 | Noffsinger | 280/651 |
| 6,910,429 | B1 * | 6/2005 | Matay et al. | 108/44 |
| 7,341,006 | B2 * | 3/2008 | Hernandez | 108/115 |
| 7,428,759 | B2 * | 9/2008 | Bain et al. | 5/86.1 |
| 7,441,786 | B2 * | 10/2008 | Stryker et al. | 280/79.11 |
| 7,611,126 | B2 * | 11/2009 | Vesa | 254/93 H |
| 2003/0062700 | A1 * | 4/2003 | Stallbaumer | 280/47.27 |
| 2005/0098967 | A1 * | 5/2005 | Hernandez | 280/32.6 |
| 2005/0161894 | A1 * | 7/2005 | Lensing | 280/32.6 |
| 2006/0170170 | A1 * | 8/2006 | Whiteside et al. | 280/32.6 |

* cited by examiner

*Primary Examiner* — Jonathan Liu
*Assistant Examiner* — Patrick Hawn
(74) *Attorney, Agent, or Firm* — J. Bennett Mullinax, LLC

(57) ABSTRACT

An under hood service tray is provided that includes a vertical member attached to a tray and a base. The base is rendered mobile through a plurality of castors and has first and second longitudinally extending legs and a laterally extending leg located between and attached to both the first and second longitudinally extending legs. The pair of longitudinally extending legs and the laterally extending leg define an opening capable of receiving at least a portion of a tire attached to an automobile therein.

14 Claims, 7 Drawing Sheets

UNDER HOOD SERVICE TRAY

FIELD OF THE INVENTION

The present invention relates generally to an under hood service tray used for holding mechanics tools during work on an automobile. More particularly, the present application involves an under hood service tray capable of being positioned at locations convenient for a mechanic during work under a raised hood of the automobile.

BACKGROUND

Work on an automobile requires the use of a variety of different mechanic tools. A service garage may maintain tools in a storage location thus forcing the mechanic to travel from a working location of the automobile to the storage location in order to retrieve the necessary tools. This task consumes both time and labor of the mechanic and thus reduces efficiency of the servicing procedure and leads to increased costs. It is therefore the case that tool trays are sometimes used to hold necessary tools at a more convenient location for the mechanic next to the work area to save labor and time.

One such tool tray includes a bracket on the bottom that is capable of being mounted onto the neck of an automobile radiator. The mechanic removes the radiator cap, fastens the bracket to the exposed neck which positions the tool tray at a location convenient for the mechanic when working under the hood of the automobile. Other such tool trays are adapted to be attached to a tie plate hood element located between the grille and radiator of the automobile. Once attached, the tool tray holds mechanics tools at a location that is convenient for the mechanic during a repair or servicing procedure. Although suitable for their intended purposes, such tool trays are difficult to carry from one location to the next, require labor and time to effect attachment of the tool tray to the vehicle, and may not be capable of being connected to different makes and models of vehicles.

Another such tool tray includes a tray that can be attached to and removed from a vertical support member that is affixed to a base. The tray can hold mechanics tools and can be removed from the vertical support member and placed onto the same surface as the automobile. The tray includes a number of castors thereon so that a mechanic working under the automobile can position the tray next to himself or herself to easily access the tools. Alternatively, when the vehicle is elevated by a hydraulic lift the tray can be reattached to the vertical support member which can be adjusted to the necessary height. The mechanics tools in the tray are then likewise located at a convenient position for access by the mechanic. Although capable of working for its intended purpose, such a tool tray due to its design cannot be positioned at various locations with respect to the automobile for ease of access when the mechanic is standing on the ground and working under the hood of the automobile. As such, there remains room for variation and improvement in the art.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which.

Figure 1:
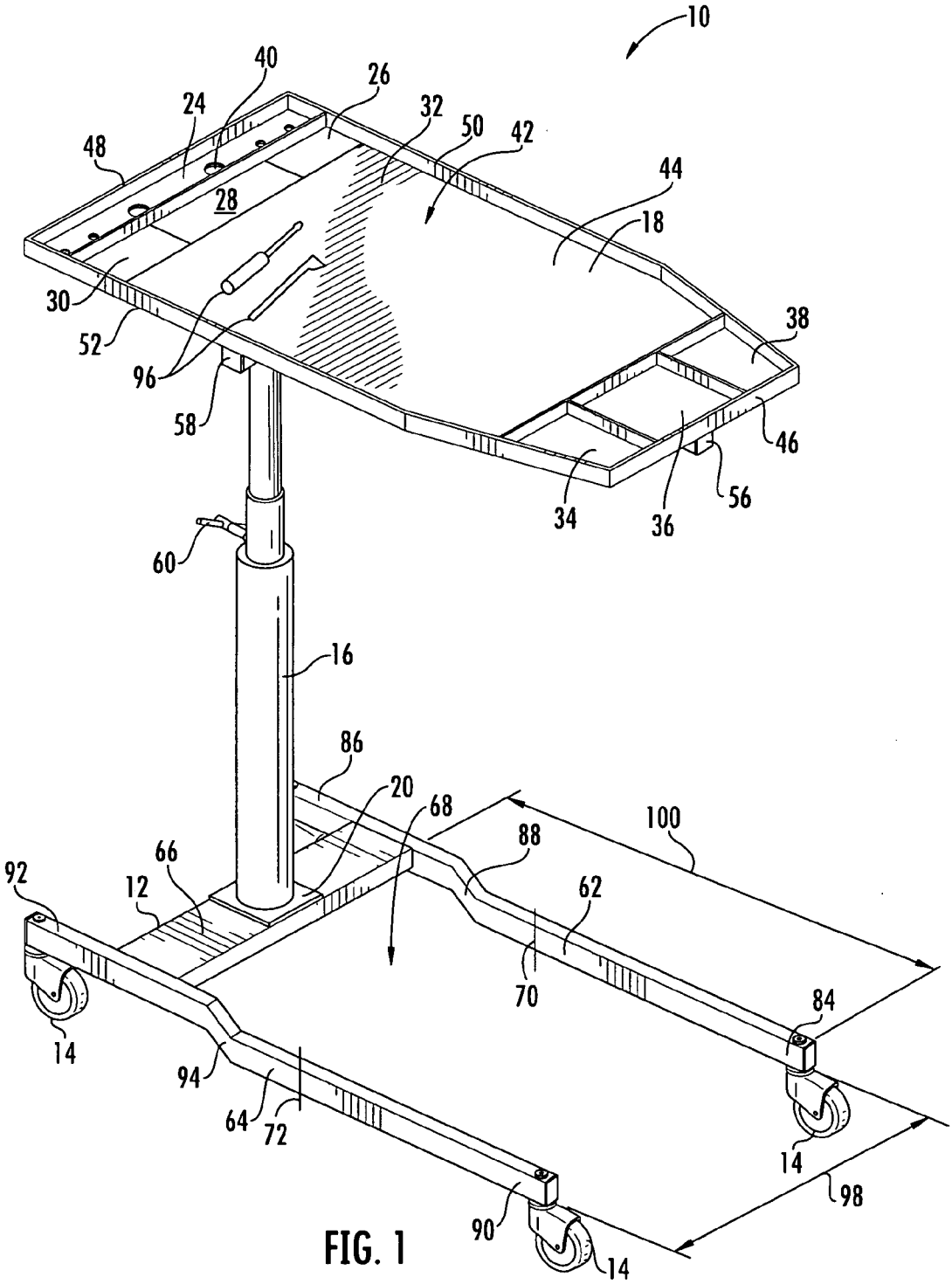
FIG. 1 is a perspective view of an under hood service tray in accordance with one exemplary embodiment.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for an under hood service tray 10 used for holding mechanic tools 96 during servicing or repair of components in an engine compartment 80 of an automobile 76 by a mechanic. A tray 18 is included that is capable of holding a plurality of mechanic tools 96 and is supported by a vertical member 16. The tray 18 is not capable of being removed from the vertical member 16 and the height of the vertical member 16 can be adjusted so as to adjust the height of the tray 18. A base 12 that features a plurality of castors 14 that render the base mobile supports the vertical member 16. The base 12 is configured to define an opening 68 into which a tire 74 of the automobile 76 can be positioned. In this manner, the under hood service tray 10 can be more conveniently located with respect to the engine compartment 80 to hold mechanic tools 96 in a location for the mechanic so as to reduce labor and time necessary in performing the desired servicing or repair.

FIG. 1 illustrates an under hood service tray 10 in accordance with one exemplary embodiment. The under hood service tray 10 includes a vertical member 16 attached to both a base 12 and a tray 18. A plurality of mechanic tools 96, such as a wrench and a screw driver, can be retained on the tray 18 and thus presented for access to the mechanic. The tray 18 includes a front wall 46 and a rear wall 48 that are parallel to one another. A pair of side walls 50 and 52 extend between the front and rear walls 46 and 48. A portion of the side walls 50 and 52 are parallel to one another, and a portion of the pair of side walls 50 and 52 are not parallel to one another. In this regard, the side walls 50 and 52 angle in towards one another in the direction towards the front wall 46. The front of the tray 18 is thus angled and has a smaller length in the lateral direction than the rest of the tray 18. This arrangement may allow the tray 18 to be more conveniently located with respect to the automobile 76 since the smaller width of the tray 18 at the front can be more easily located within areas of the automobile 76 such as under the hood 78. The front of the tray 18 may be the portion of the tray 18 that is located furthest under the hood 78 during use.

Figure 3:
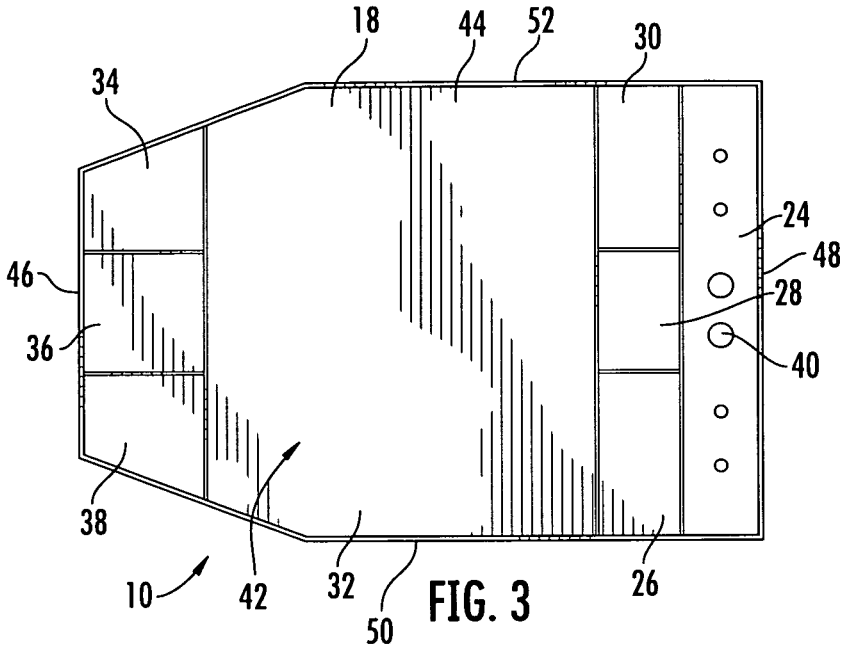
FIG. 3 is a top view of the under hood service tray of FIG. 1.
Figure 4:
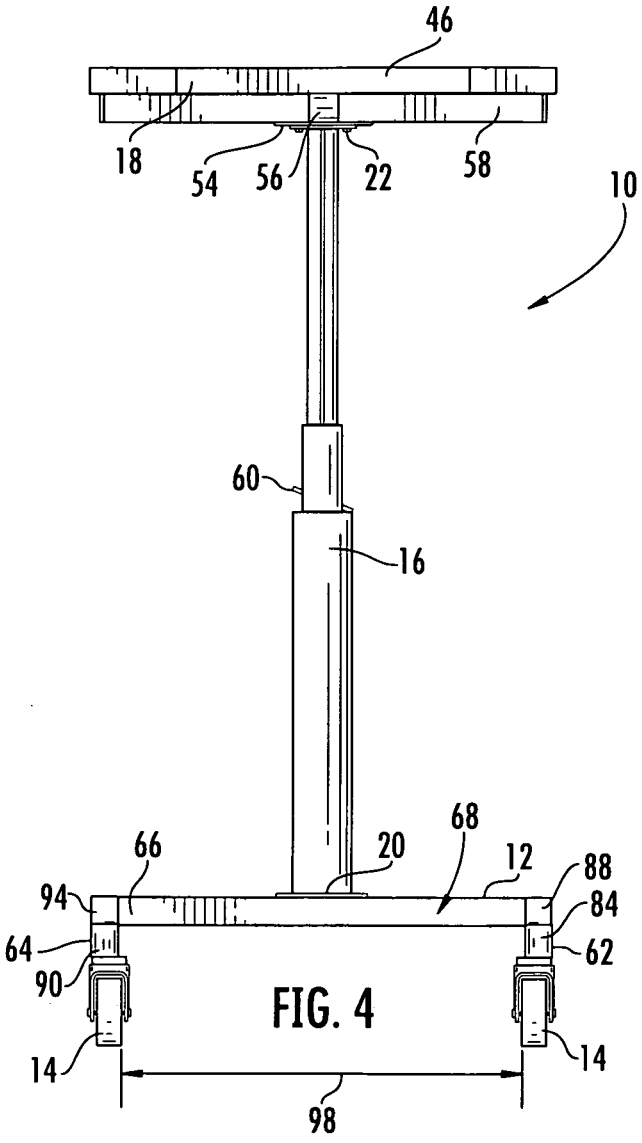
FIG. 4 is front view of the under hood service tray of FIG. 1.

With reference now to both FIGS. 1 and 3, a plurality of open compartments are formed on the upper surface 42 of the tray 18. The compartments can be used to organize and hold different types of mechanic tools 96 that are used to accomplish different tasks with respect to the servicing and repair of the automobile 76. Eight open compartments 24, 26, 28, 30, 32, 34, 36 and 38 are defined on the upper surface 42 by the walls 46, 48, 50 and 52 and interior walls of the tray 18. However, it is to be understood that any number of compartments can be defined in the tray 18 in accordance with various exemplary embodiments. For example, from one to fifteen compartments may be defined in the tray 18 in accordance with other exemplary embodiments.

Slip resistant material 44 can be included on the upper surface 42 in order to inhibit the sliding or movement of mechanic tools 96 located on the tray 18. The slip resistant material 44 may be a material that has a higher coefficient of friction than other portions of the tray 18 such as the walls 46, 48, 50 or 52. In this regard, the slip resistant material 44 may be made of a material such as rubber or plastic while other portions of the tray 18 are made of a metal such as steel or aluminum. As shown, the slip resistant material 44 is located within compartments 26, 28, 30, 32, 34, 36 and 38 and is not located within compartment 24. However, the slip resistant material 44 may be located within all or none of the compartments of the tray 18 in accordance with different exemplary embodiments. Additionally, the slip resistant material 44 may be located on the outside surfaces of the tray 18 such as on the outside surfaces of the walls 46, 48, 50 and 52. Placement of the slip resistant material 44 at these locations of the tray 18 may act as a guard against marring or scratching of the automobile 76 that would otherwise occur upon contact of the automobile 76 by harder or sharper portions of the tray 18.

The compartments may be provided so that compartment 32 that is located in the middle of the tray 18 is the largest compartment. Three smaller compartments 26, 28 and 30 may be located rearward of compartment 32 for the storage of smaller mechanic tools 96, and three smaller compartments 34, 36 and 38 may be located forward of compartment 32 for holding smaller mechanic tools 96. However, it is to be understood that the compartments can be variously sized and configured in accordance with other exemplary embodiments.

A plurality of apertures 40 are disposed through the tray 18 and are located in compartment 24. The apertures 40 can be used to hold various mechanic tools 96 such as pneumatic wrenches or drills. The apertures 40 may be located at the compartment 24 proximate to the rear wall 48 so that cords extending from mechanic tools 96 located in the apertures 40 are less likely to interfere with servicing or repair of the automobile 76 since they are located more remote from the automobile 76 during use of the tray 10. Although shown as being generally flat in shape, the upper surface 42 may include recesses or other features in accordance with other exemplary embodiments that may function to more securely hold mechanic tools 96 as desired. The upper surface 42 of tray 10 can be located a distance from 3 feet to 6 feet, from 3 feet to 4 feet, from 4 feet to 5 feet, from 5 feet to 6 feet, or from 2 feet to 4 feet from the base 12 or the surface 82 onto which the tray 10 rests. In other embodiments, the upper surface 42 may be located up to 4 feet, up to 5 feet, or up to 6 feet from the base 12 or the surface 82 onto which the tray 10 rests.

Figure 2:
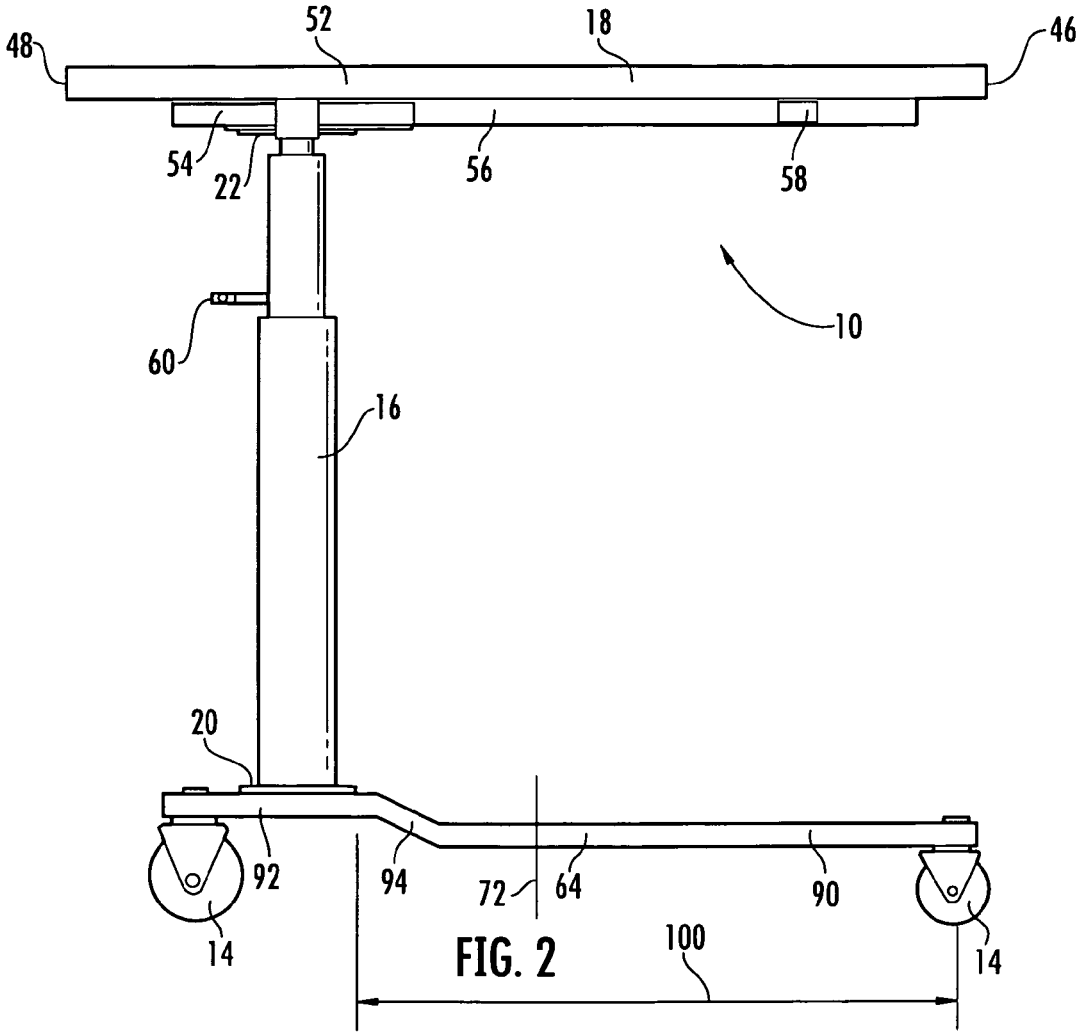
FIG. 2 is a side view of the under hood service tray of FIG. 1.
Figure 5:
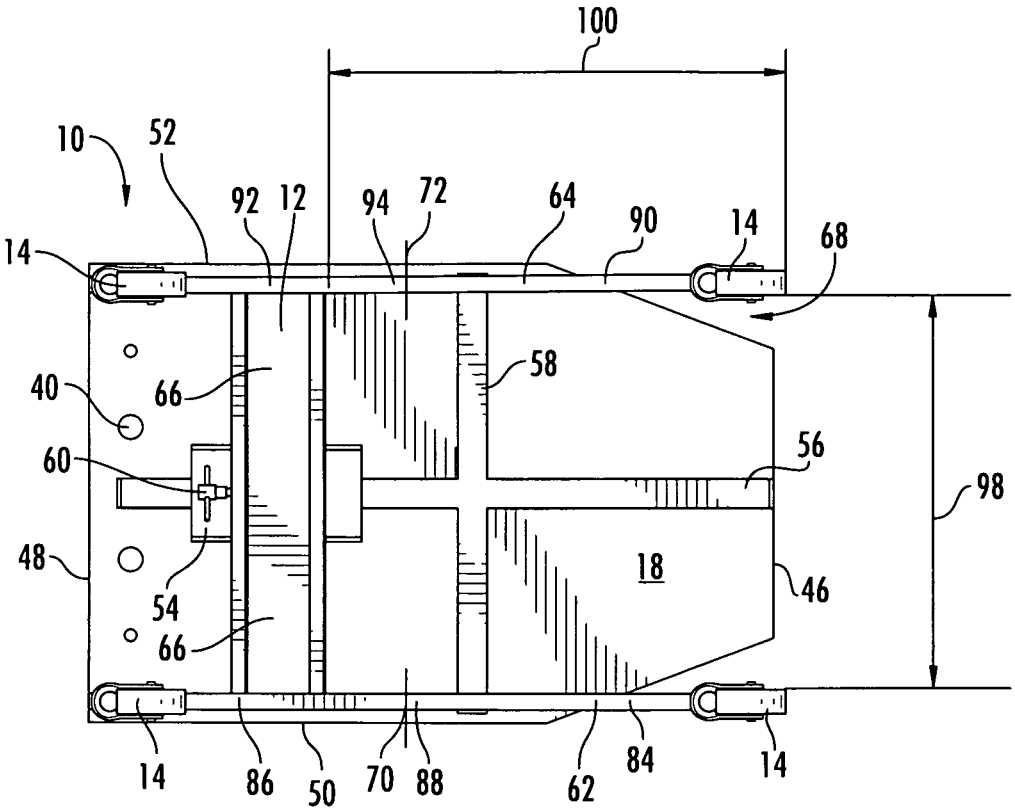
FIG. 5 is a bottom view of the under hood service tray of FIG. 1.

The tray 18 includes a pair of reinforcing members 56 and 58 that can be more easily seen with reference to FIGS. 2 and 5. The reinforcing members 56 and 58 function to strengthen the tray 18 and may have a cross-section that is square tubular in shape in accordance with one exemplary embodiment. Longitudinally extending reinforcing member 56 is located at the lateral midpoint of the tray 18 and extends in the longitudinal direction under the upper surface 42. Laterally extending reinforcing member 58 is also located under the upper surface 42 and extends in the lateral direction of the tray 18 and intersects the longitudinally extending reinforcing member 56. Tray 18 also includes a mounting bracket 54 that has a generally open channel shape. The mounting bracket 54 may be located so that a portion of the length of the longitudinally extending reinforcing member 56 is located within the channel formed by the mounting bracket 54. The mounting bracket 54 may be located at the lateral midpoint of the tray 18 and an end 22 of the vertical member 16 may be attached thereon. End 22 can be bolted, welded or otherwise attached to the mounting bracket 54 in such a manner that the tray 18 is not removable from the vertical member 16. Further, the connection can be effected so that the tray 18 is not capable of being rotated with respect to the vertical member 16 or the base 12. In accordance with certain exemplary embodiments, the vertical member 16 and the tray 18 may be an integral piece such that they are attached to one another in this regard.

The vertical member 16 may be a fixed member so that its height is not capable of being adjusted. In accordance with other exemplary embodiments, the vertical member 16 may be capable of being adjusted so that its height, and consequently the height of the tray 16, can be varied as desired. Modification of the height of the vertical member 16 may allow the tray 18 to be located at a height that is more convenient for the mechanic. The vertical member 16 may be a telescoping member such that portions of the vertical member 16 nest within one another. The user may pull the innermost portion of the vertical member 16 upwards or downwards to a desired location, and a retaining pin 60 can be inserted therethrough in order to fix the height of the vertical member 16. The user can subsequently remove the retaining pin 60 should a readjustment of the height of the vertical member 16 be desired. The vertical member 16 may be arranged in a variety of manners so as to be rendered adjustable in the vertical direction. In accordance with one exemplary embodiment, the vertical member 16 may have a crank mechanism that can be actuated by the user so as to effect raising and lowering of the vertical member 16. In yet other exemplary embodiments, the vertical member 16 may include a hydraulic component that can be actuated by the user so as to effect an adjustment in the vertical direction.

The base 12 of the under hood service tray 10 is shown with reference to FIGS. 1 and 5. The base 12 includes a longitudinally extending leg 62 and a longitudinally extending leg 64. A laterally extending leg 66 is located between and is attached to both of the longitudinally extending legs 62 and 64. An end 20 of the vertical member 16 is attached to the lateral midpoint of the laterally extending leg 66. The attachment between end 20 and the laterally extending leg 66 may effected through welding, bolts or other mechanical fasteners such that the resulting connection is not capable of being removed. Further, in accordance with certain exemplary embodiments the connection between end 20 and laterally extending leg 66 may be made so that the vertical member 16 is not capable of being rotated with respect to the laterally extending leg 66. Laterally extending leg 66 can be generally channel shaped such that the open portion of the channel faces downwards. The laterally extending leg 66 may be a single integral piece in certain exemplary embodiments and may be made of steel or aluminum.

The laterally extending leg 66 can be positioned in the base 12 so that it is not located at the longitudinal midpoint 70 of the longitudinally extending leg 62 or at the longitudinal midpoint 72 of the longitudinally extending leg 64. In this regard, the laterally extending leg 66 is located towards the rearward ends of the longitudinally extending legs 62 and 64. Laterally extending leg 66 can be attached to longitudinally extending legs 62 and 64 by way of bolts, screws, various mechanical fasteners or welding. In further exemplary embodiments, the laterally extending leg 66 may be integrally formed with the longitudinally extending legs 62 and 64. The base 12 may be arranged so that up to 25% of the length of the longitudinally extending legs 62 and 64 is located on one side of the laterally extending leg 66. In accordance with other exemplary embodiments, up to 5%, up to 10%, up to 15%, or up to 20% of the length of the longitudinally extending legs 62 and 64 may be located on one side of the laterally extending leg 66. The longitudinally extending legs 62 and 64 in addition to the laterally extending leg 66 may define an opening 68 on one end of the base 12. Opening 68 has an open front end and may not include material within the perimeter defined by the longitudinally extending legs 62 and 64 and the laterally extending leg 66 up to the tray 18. The opening 68 may have a width 98 of 12 inches in accordance with one exemplary embodiment. In accordance with other exemplary embodiments, the width 98 may be from 6 inches to 10 inches, from 10 inches to 15 inches, from 15 inches to 20 inches, or up to 36 inches. Opening 68 may have a length 100 that is 24 inches. In accordance with other exemplary embodiments, length 100 may be from 12 inches to 18 inches, from 18 inches to 24 inches, from 24 inches to 36 inches, or up to 48 inches. It is to be understood, however, that the disclosed widths 98 and lengths 100 are only exemplary and that others are possible in accordance with other exemplary embodiments of the under hood service tray 10.

With reference now to FIGS. 1 and 2, longitudinally extending leg 62 includes a first portion 84 connected to a second portion 86 by way of an intermediate portion 88. The first portion 84 is located at a height that is less than the height of the second portion 86. As such, the second portion 86 is located generally closer to the tray 18 than the first portion 84. The intermediate portion 88 connects the two portions 84 and 86 and extends at an angle to both the longitudinal and vertical directions. The laterally extending leg 66 is attached to the second portion 86 and is located generally above the first portion 84. The longitudinally extending leg 62 can be a single integral piece or may be made of multiple components in accordance with different exemplary embodiments that are welded or otherwise attached to one another.

Longitudinally extending leg 62 may be made out of steel or aluminum in accordance with certain exemplary embodiments. Portions 84, 86 and 88 may have a square tubular cross-sectional shape that are of the same size in accordance with certain exemplary embodiments. In yet other embodiments, the cross-sectional shape of the second portion 86 may be larger than the cross-sectional shape of the first portion 84.

Longitudinally extending leg 64 may be provided with a first portion 90, second portion 92, and an intermediate portion 94 that functions to connect the first portion 90 and second portion 92. The portions 90, 92 and 94 in addition to the longitudinally extending leg 64 may be arranged and provided in a manner similar to those disclosed with respect to portions 84, 86 and 88 and leg 62 as discussed above and a repeat of this information is not necessary.

The second portions 86 and 92 may be located at a height above that of the first portions 84 and 90 to effect a design of base 12 that is stronger towards the rear end thereof due to the positioning of the vertical member 16 and tray 18 thereto. The intermediate portions 88 and 94 are angled downwards from the second portions 86 and 92 to further strengthen the base 12 as a stronger load bearing portion of the base is located on one side of the intermediate portions 88 and 94.

Castors 14 are provided on base 12 and are attached to the longitudinally extending legs 62 and 64. A pair of castors 14 are located proximate to opposite ends of the longitudinally extending leg 62, and a pair of castors 14 are located proximate to the opposite ends of the longitudinally extending leg 64. The sizes of the castors 14 and their load bearing rating need not be identical. Elevation of the second portions 86 and 92 above the first portions 84 and 90 dictate that the circumference of the castors 14 attached to the second portions 86 and 92 be larger than the circumference of castors 14 attached to the first portions 84 and 90. The load bearing capacity of the castors 14 attached to the second portions 86 and 92 may be greater than that of those attached to the first portions 84 and 90 as these castors 14 are more closely positioned to the vertical member 16 and may hold more of the weight of the vertical member 16, tray 18 and carried mechanic tools 96. However, it is to be understood that in other exemplary embodiments the load bearing capacity and the size of all of the castors 14 of the under hood service tray 10 may be identical.

Figure 6:
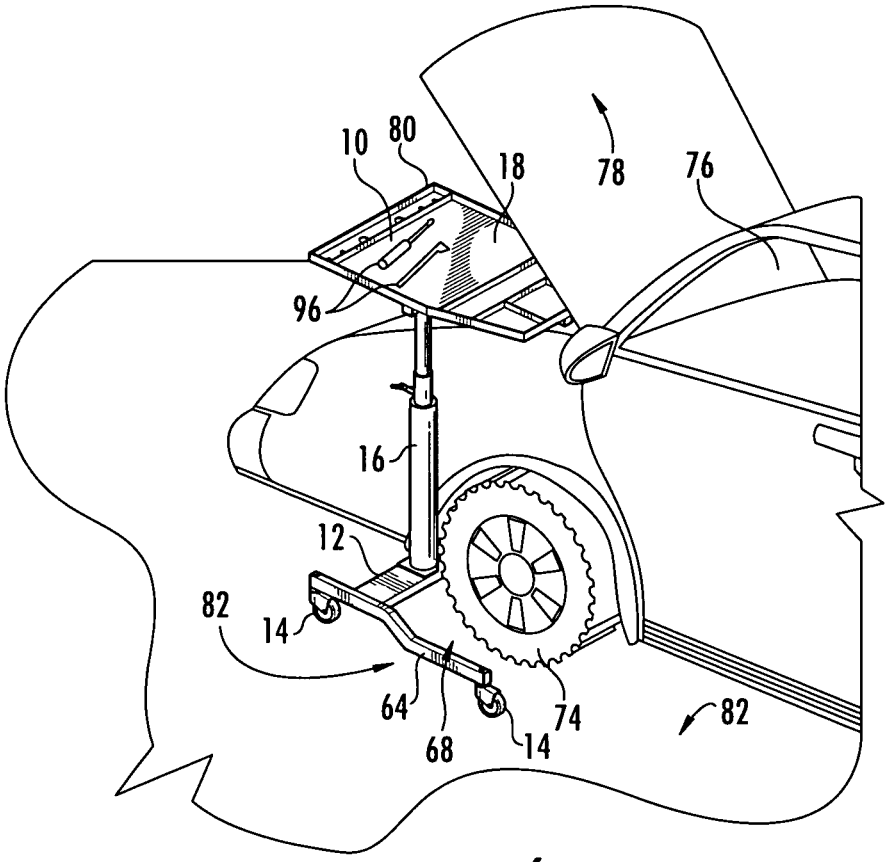
FIG. 6 is a perspective view of the under hood service tray of FIG. 1 placed next to an automobile for use by a mechanic.

FIG. 6 illustrates a perspective view of the under hood service tray 10 as employed by a mechanic during the servicing or repair of an automobile 76. The service or repair may be performed on areas of the automobile 76 that are under the hood 78. For example, components in the engine compartment 80 may be serviced or repaired with the aid of mechanics tools 96 that are initially located on the under hood service tray 10. The tires 74 of the automobile 76 and the castors 14 of the under hood service tray 10 may be located on the same surface 82. The mechanic can roll the under hood service tray 10 across surface 82 so that the under hood service tray 10 is positioned at a desired location with respect to the automobile 76. In accordance with one exemplary embodiment, the tray 10 can be positioned so that the opening 68 defined by the legs 62, 64 and 66 has a portion of the front tire 74 of the automobile 76 located therein. The longitudinally extending legs 62 and 64 are wider than the width of the tire 76 so that the tire 74 can be located therebetween. The under hood service tray 10 is generally open between the base 12 and the tray 18 in the area forward of the vertical member 16. This open structure allows a portion of the automobile 76, such as a portion of the front bumper and the front fender, to be located therein. The vertical member 16 remains forward of or makes contact with the front bumper of the automobile 76. The tray 18 can be located at a position within the automobile 76 that allows easier access to mechanic tools 96 located on the tray 18 and allows easier placement of mechanic tools 96 onto the tray 18 during a repair or servicing procedure. A portion of the tray 18 may be located directly above the tire 74. Further, a portion of the tray 18 may be located above portions of the automobile 76 while other portions of the tray 18 are located outboard from the automobile 76 and are not located above any portion of the automobile 76. The angled side walls 50 and 52 of the tray 18 may allow for easier access to the engine compartment 80 as a portion of the tray 18 is narrower and is positioned so as to take up less space under the hood 78. Although shown as being used with the left front tire 74 of the automobile 76, it is to be understood that the under hood service tray 10 can be positioned next to the right front tire 74 in accordance with other exemplary embodiments.

Figure 7:
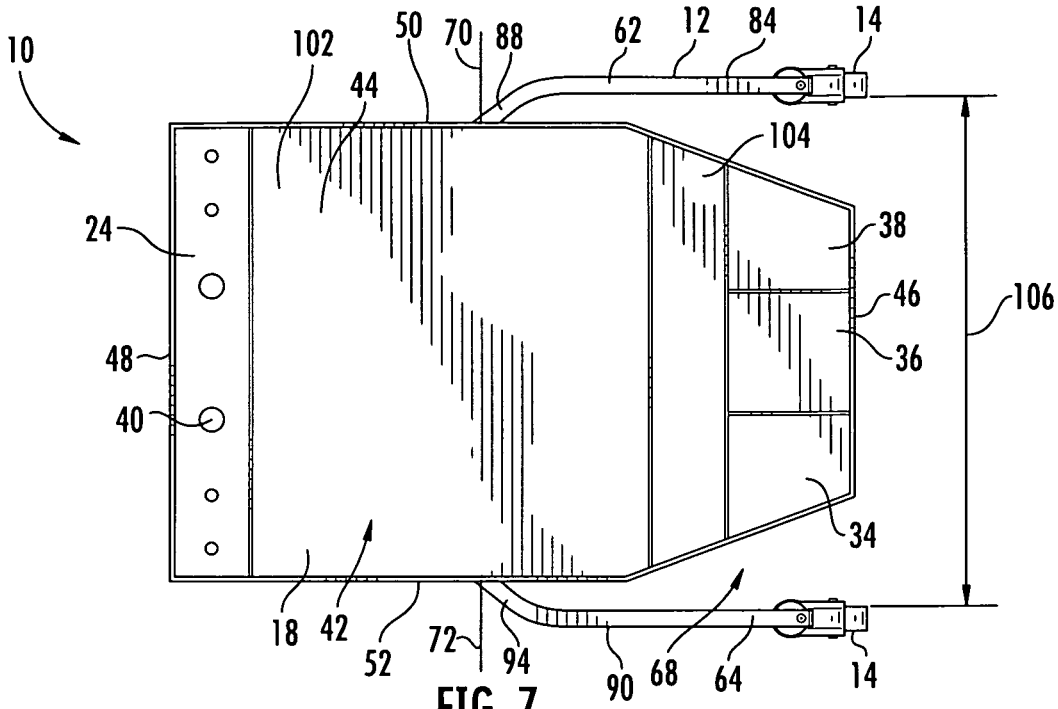
FIG. 7 is a top view of an under hood service tray in accordance with an alternative exemplary embodiment.
Figure 8:
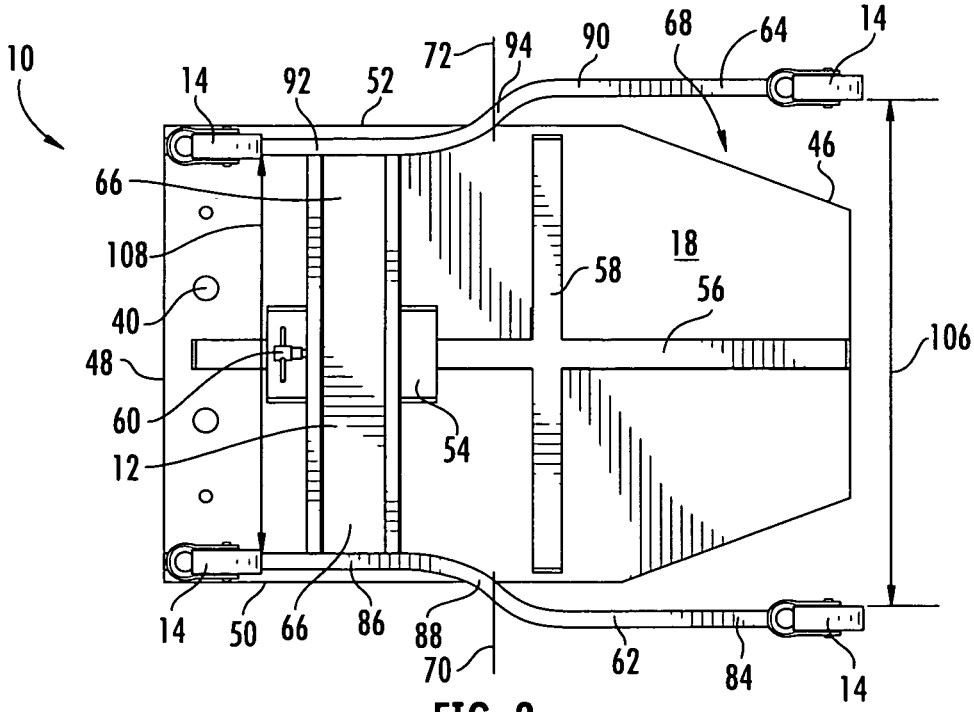
FIG. 8 is a bottom view of the under hood service tray of FIG. 7.

FIGS. 7 and 8 illustrate an alternative exemplary embodiment of the under hood service tray 10. As shown, the tray 18 has compartments 24, 34, 36 and 38 that are shaped and configured the same as those of tray 18 in earlier described embodiments. However, tray 18 as shown in FIGS. 7 and 8 also includes compartments 102 and 104 that are configured differently than those of earlier described embodiments. In this regard, compartment 104 is located adjacent compartments 34, 36 and 38, and compartment 102 is located adjacent compartments 24 and 104. Slip resistant material 44 is located within compartments 34, 36, 38, 102 and 104 and is not located within compartment 24.

The exemplary embodiment illustrated in FIGS. 7 and 8 includes a base 12 that is provided with a pair of longitudinally extending legs 62 and 64 and a laterally extending leg 66. Longitudinally extending leg 62 includes a first portion 84 that is located laterally outboard from a second portion 86. An intermediate portion 88 extends at least partially in the laterally outboard direction and is connected to both the first portion 84 and the second portion 86. In a similar manner, longitudinally extending leg 64 includes a first portion 90 that is located laterally outboard from a second portion 92. Intermediate portion 94 extends in the laterally outboard direction and is connected to both the first portion 90 and the second portion 92. The first portions 84 and 90 are parallel to one another and are located a greater distance apart than the second portions 86 and 92 that are also parallel to one another. The opening 86 may be made wider though the orientation of the longitudinally extending legs 62 and 64 so that the width of a tire 74 can be located therein to effect a desired positioning of the under hood service tray 10 with respect to the automobile 76.

The first portions 84 and 90 may be located a distance 106 from one another that can be 12 inches, from 12 inches to 18 inches, from 18 inches to 24 inches, or up to 36 inches in accordance with certain exemplary embodiments. Second portions 86 and 92 can be located a closer distance 108 that is less than the distance 106. Distance 108 may be up to 12 inches, up to 18 inches, or up to 24 inches in accordance with various exemplary embodiments. Distance 106 may be selected so that it is greater than the width of the tray 18 located along the same longitudinal length as the first portions 84 and 90. Distance 108 may be selected so that it is less than or equal to the width of the tray 18 that is along the same longitudinal length as the second portions 86 and 92.

The intermediate portions 88 and 94 extend in the lateral direction but not in the vertical direction so that all of the portions 84, 86, 90 and 92 are located at the same vertical height. In this arrangement, all of the castors 14 are identical to one another with respect to their circumference. However, castors 14 located closer to the vertical member 16 may have a higher load bearing capacity than the other castors 14 of the under hood service tray 10.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed:

1. An under hood service tray, comprising:

a base having a plurality of castors thereon so as to render the base mobile on a surface onto which the base is located, wherein the base has a pair of longitudinally extending legs and a laterally extending leg that is attached to and extends between the longitudinally extending legs, wherein a forward one of the castors is attached to each longitudinally extending leg and wherein a rearward one of the castors is attached to each longitudinally extending leg, wherein the laterally extending leg defines a portion of an opening that has an open front end capable of receiving at least a portion of a tire attached to an automobile therein and is attached to the longitudinally extending legs at a location that is completely between the locations of attachment of the forward and rearward castors to the longitudinally extending legs in a longitudinal direction, wherein the longitudinally extending leas and the laterally extending leg define a second opening that has an open back end such that the laterally extending leg is located between the opening and the second opening and each of the longitudinally extending legs has a first portion and a second portion, wherein the first portion of each of the longitudinally extending legs is located at a height that is less than the height location of the second portion of each of the longitudinally extending legs with the forward castors attached to the first portion of each of the longitudinally extending legs and is at a point of attachment that is at a height lower than a point of attachment of the rearward castors attached to the second portion of each of the longitudinally extending legs;

a vertical member having a first end and a second end, the first end of the vertical member centrally attached to the lateral extending leg of the base; and a tray attached to the second end of the vertical member opposite to the first end to which the base is attached, wherein the tray is attached to the vertical member such that the tray is not capable of being removed from the vertical member; and at least six compartments are defined on the upper surface of the tray, wherein the tray has a front wall and a rear wall that are parallel to one another, and wherein the tray has a pair of side walls that extend between the front wall and the rear wall, wherein the pair of side walls are angled such that a portion of the pair of side walls are parallel to one another and a portion of the pair of side walls are not parallel to one another, wherein the outer surfaces of the front wall, the rear wall and the pair of side walls have a slip resistant material located thereon that has a higher coefficient of friction that other portions of the tray.

2. The under hood service tray as set forth in claim 1, wherein slip resistant material is located on the upper surface of the tray within some of the plurality of open compartments, wherein the slip resistant material has a higher coefficient of friction than other portions of the tray.

3. The under hood service tray as set forth in claim 1, wherein a plurality of apertures are defined through the tray and are located within the perimeter of one of the open compartments of the tray.

4. The under hood service tray as set forth in claim 1, wherein the tray has a mounting bracket rigidly attached to the bottom surface of the tray, wherein the end of the vertical member is attached to and contacts the mounting bracket, wherein the tray has a longitudinally extending reinforcing member and a laterally extending reinforcing member that are rigidly attached to the bottom surface of the tray, wherein the longitudinally extending reinforcing member and the laterally extending reinforcing member have a square tubular cross-section.

5. The under hood service tray as set forth in claim 1, wherein the height of the vertical member is capable of being adjusted so as to change the distance between the base and the tray.

6. The under hood service tray as set forth in claim 5, wherein the vertical member is a telescoping vertical member, and wherein the base is attached to the vertical member such that the base is not capable of being removed from the vertical member and is not capable of rotating with respect to the vertical member.

7. The under hood service tray as set forth in claim 1, wherein the pair of longitudinally extending legs are at least 12 inches apart from one another along at least a portion of the lengths of the pair of longitudinally extending legs.

8. An under hood service tray, comprising:

a tray;

a vertical member attached to the tray; and a base attached to the vertical member, wherein the base has a plurality of castors located thereon so as to render the base mobile on a surface onto which the base is located, wherein the base has a first longitudinally extending leg and a second longitudinally extending leg and a laterally extending leg located between and attached to both the first and second longitudinally extending legs, wherein the pair of longitudinally extending legs and the laterally extending leg define a first opening capable of receiving at least a portion of a tire attached to an automobile therein and define a second opening that has an open back end such that the laterally extending leg is located between the first opening and the second opening;

wherein the first longitudinally extending leg has a first portion and a second portion, wherein the first portion of the first longitudinally extending leg is located at a height that is less than the height location of the second portion of the first longitudinally extending leg, and wherein the second longitudinally extending leg has a first portion and a second portion, wherein the first portion of the second longitudinally extending leg is located at a height that is less than the height location of the second portion of the second longitudinally extending leg, wherein a first castor is attached to the first portion of the first longitudinally extending leg and is at a point of attachment that is at a height lower than a point of attachment of a second castor that is attached to the second portion of the first longitudinally extending leg;

wherein the vertical member is centrally located on the lateral extending leg of the base completely longitudinally forward of the second castor and part of the second portion of the first longitudinally extending leg, and wherein the vertical member is located completely longitudinally rearward of a different part of the second portion of the first longitudinally extending leg; and at least six open compartments are defined on the upper surface of the tray, wherein slip resistant material is located on the upper surface of the tray within some but not all of the plurality of open compartments, wherein the slip resistant material has a higher coefficient of friction than other portions of the tray, wherein the tray has a front wall and a rear wall that are parallel to one another, wherein the tray has a pair of side walls that extend between the front and rear wall and are angled such that a portion of the pair of side walls are parallel to one another and such that a portion of the pair of side walls are not parallel to one another, wherein the portion of the pair of side walls that are not parallel to one another is located above the opening defined by the pair of longitudinally extending legs and the laterally extending leg.

9. The under hood service tray as set forth in claim 8, wherein the laterally extending leg is not located at the longitudinal midpoint of the first longitudinally extending leg, and wherein the laterally extending leg is not located at the longitudinal midpoint of the second longitudinally extending leg.

10. The under hood service tray as set forth in claim 8, wherein the first longitudinally extending leg has an intermediate portion located between the first portion and the second portion of the first longitudinally extending leg, wherein the second longitudinally extending leg has an intermediate portion located between the first portion and the second portion of the second longitudinally extending leg, wherein the first portion of the first longitudinally extending leg and the first portion of the second longitudinally extending leg are parallel to one another and are located at least 12 inches apart from one another.

11. The under hood service tray as set forth in claim 8, wherein the castors extend from the bottom surfaces of the first and second longitudinally extending legs at locations proximate to the longitudinal ends of the first and second longitudinally extending legs.

12. The under hood service tray as set forth in claim 8, wherein the vertical member is attached on one end to the laterally extending leg, wherein the vertical member is attached on an opposite end to the tray such that the tray is not capable of being removed from the vertical member, wherein the height of the vertical member is capable of being adjusted so as to change the distance between the base and the tray.

13. The under hood service tray as set forth in claim 8, wherein the tray has a mounting bracket rigidly attached to the bottom surface of the tray, wherein the end of the vertical member is attached to and contacts the mounting bracket, wherein the tray has a longitudinally extending reinforcing member and a laterally extending reinforcing member that are rigidly attached to the bottom surface of the tray, wherein the longitudinally extending reinforcing member and the laterally extending reinforcing member have a square tubular cross-section.

14. An under hood service tray, comprising:

a tray;

a vertical member attached to the tray; and a base attached to the vertical member, wherein the base has a plurality of castors located thereon so as to render the base mobile on a surface onto which the base is located, wherein the base has a first longitudinally extending leg and a second longitudinally extending leg and a laterally extending leg located between and attached to both the first and second longitudinally extending legs, wherein the pair of longitudinally extending legs and the laterally extending leg define a first opening capable of receiving at least a portion of a tire attached to an automobile therein and define a second opening that has an open back end such that the laterally extending leg is located between the first opening and the second opening;

wherein the first longitudinally extending leg has a first portion and a second portion, wherein the first portion of the first longitudinally extending leg is located at a height that is less than the height location of the second portion of the first longitudinally extending leg, and wherein the second longitudinally extending leg has a first portion and a second portion, wherein the first portion of the second longitudinally extending a height that is less than the second portion of the second longitudinally extending leg, wherein a first castor is attached to the first portion of the first longitudinally extending leg and is at a point of attachment that is at a height lower than a point of attachment of a second castor that is attached to the second portion of the first longitudinally extending lea;

wherein the vertical member is located on the lateral extending leg of the base completely longitudinally forward of the second castor and part of the second portion of the first longitudinally extending leg, and wherein the vertical member is located completely longitudinally rearward of a different part of the second portion of the first longitudinally extending leg;

wherein the laterally extending leg is not located at the longitudinal midpoint of the first longitudinally extending leg, and wherein the laterally extending leg is not located at the longitudinal midpoint of the second longitudinally extending leg; and wherein the first portion of the first longitudinally extending leg is located outboard from the second portion of the first longitudinally extending leg in the lateral direction, and wherein the first portion of the second longitudinally extending leg is located outboard from the second portion of the second longitudinally extending leg in the lateral direction.

* * * * *